US006763633B2

(12) United States Patent
Côte

(10) Patent No.: US 6,763,633 B2
(45) Date of Patent: Jul. 20, 2004

(54) PORTABLE ENCLOSURE

(75) Inventor: Roger Côte, Brampton (CA)

(73) Assignee: Roger Côté, Brampton (CA)

( * ) Notice: Subject to any disclaimer, the term of this patent is extended or adjusted under 35 U.S.C. 154(b) by 98 days.

(21) Appl. No.: 10/255,601

(22) Filed: Sep. 27, 2002

(65) Prior Publication Data

US 2003/0140577 A1 Jul. 31, 2003

(51) Int. Cl.[7] ..... E04H 1/12; E04H 15/00; E04H 6/02; E04B 1/343

(52) U.S. Cl. ..... 52/71; 52/79.5; 52/143; 135/912; 135/128; 135/143

(58) Field of Search ..... 52/64, 71, 79.5, 52/143; 135/912, 88.13, 128, 143, 151

(56) References Cited

U.S. PATENT DOCUMENTS

| | | | | |
|---|---|---|---|---|
| 1,765,295 A | | 6/1930 | Beckman | |
| 2,155,876 A | | 4/1939 | Stout | |
| 2,755,517 A | | 7/1956 | Sickel | |
| 3,296,752 A | * | 1/1967 | Philp | 52/70 |
| 4,026,076 A | | 5/1977 | Analetto | |
| 4,045,926 A | | 9/1977 | Gibbs | |
| 4,078,341 A | * | 3/1978 | Peterson et al. | 52/71 |
| 4,170,852 A | * | 10/1979 | Danis, Jr. | 52/71 |
| 4,232,488 A | | 11/1980 | Hanley | |
| 4,976,485 A | | 12/1990 | Jonckheere | |
| 5,152,109 A | | 10/1992 | Boers | |
| 5,327,698 A | | 7/1994 | Uhl | |
| 5,461,832 A | | 10/1995 | Smith | |
| 5,921,033 A | * | 7/1999 | Molina | 52/67 |
| 5,960,593 A | | 10/1999 | Murphy | |
| 6,082,059 A | | 7/2000 | Loomans | |
| 6,434,895 B1 | * | 8/2002 | Hosterman et al. | 52/143 |

FOREIGN PATENT DOCUMENTS

| | | |
|---|---|---|
| FR | 802239 | 8/1936 |
| GB | 1367064 | 9/1974 |

* cited by examiner

*Primary Examiner*—Robert Canfield
(74) *Attorney, Agent, or Firm*—Marks & Clerk

(57) ABSTRACT

A portable enclosure for temporary shelter purposes as a storage building or workshop at remote construction sites comprises a plurality of articulable frames mounted on a towable boom, which may be coupled to a towing tractor, and which has wheels at the other end so that it may be towed. Each of the frames has first to fourth frame members, with a first cylinder mounted between the boom and the first frame member to adjust the tilted disposition of that member with respect to the boom to vertical. The angle between the second and third members is adjusted by a second cylinder. The fourth member also assumes a vertical orientation. Thus, each of the first and fourth frame members of each frame is articulable to a substantially vertical orientation, and they are horizontally distanced one from the other so as to form a storage or workshop space between them.

12 Claims, 3 Drawing Sheets

PORTABLE ENCLOSURE

FIELD OF THE INVENTION

This invention relates to portable enclosures, and particularly to portable enclosures which may be towed to remote construction sites for use as storage buildings or workshops. The portable enclosure is effectively collapsible for towing purposes, but may be opened to become such as a storage building or workshop at a remote construction site due to the presence of a plurality of articulable frames which are mounted to and swing away from the towable boom.

BACKGROUND OF THE INVENTION

There are many remote construction sites scattered throughout the world. Some may be several kilometers or several hundred kilometers from cities or towns, such as construction sites for supporting the construction of energy transmission lines such as electricity power lines, gas and oil pipe lines, and the like. Other construction sites are further remote, at mine sites, where the head works for a mine may be under construction, or where defence installations are being constructed, at hydro electric construction sites, and the like.

Most such construction sites are accessible, at least in part, by road, or over frozen tundra or ice, whereby wheeled or tracked vehicles may come to those sites. What is common at such sites, however, is that they typically will have a variety of earth moving equipment, other heavy construction equipment, construction supplies, and the like. What is also common in such remote construction sites is that they are temporary in their nature. They might exist at a particular location for several months, or perhaps even several years, but not for lengthy periods of time.

Also, at such construction sites, there is not only the necessity to store construction materials, and protect them from the elements in some respect or other, there is also a necessity to protect heavy earth moving and other technical equipment from the elements especially when they are being repaired. It is very costly for construction equipment to be out of service; but it is sometimes not possible to repair or maintain equipment without the equipment being sheltered in one way or another.

For example, at construction sites in the far north, typically work is carried on during whatever daylight hours there may be, and repair and maintenance is carried on during darkness hours. However, since such locations may be very cold, and typically the mechanics and other workers who repair and maintain such equipment wear light clothing and gloves, they require shelter.

A typical shelter, previously, could be such as a shed or hut having aluminum or coated steel skin on the outside, or it could be such as a tent.

However, portable huts and the like require substantial ground preparation, the placement of footings, and the require erection at the site. That requirement, in itself, may take a team of construction workers a number of days or weeks, before any actual construction work can begin at the construction site.

If tents are used, they are typically quite small; or if they are large, they require the use of centre poles, and therefore have limited free span width for location of large and heavy equipment such as earth moving equipment and the like.

Of course, it is well known to heat such enclosures with gas powered heaters, and the workers who work within such enclosures are accustomed to the hardships otherwise of such conditions.

The present invention overcomes the difficulties described above by providing a portable enclosure which may be towed to a construction site and erected at the site by actuation of a plurality of operating cylinders—typically, hydraulic cylinders. Thus, portable enclosures in keeping with the present invention may be towed on public highways and roads for as far as possible, and then over temporary roads or the like up to the construction site. The portable enclosure may then be erected in a manner of, five to thirty minutes. Furthermore, only one single worker is required to erect and collapse the portable enclosure, making operation of the portable enclosure a much more labour cost effective task than the building of portable huts or tents which typically requires a team of construction workers. Thus, the economies of the use portable enclosures in keeping with the present invention, even if they require higher capital costs initially, can be well understood and appreciated.

Obviously, and as will be described in greater detail hereafter, once a portable enclosure in keeping with the present invention is erected, it provides ample free span width to accommodate earth moving equipment and the like; and the portable enclosure may be clad with tarpaulin or other web-like fabric which can be completely closed, whereby a warm enclosure may be provided within a minimum period of time.

Typically, portable enclosures in keeping with the present invention may be adjusted as to their height and width, after they have been otherwise erected by actuation of their articulable frame members, as described hereafter. Thus, the specific requirements at one remote construction site may differ from those at another remote construction site, and yet the same portable enclosure may be used at both.

DESCRIPTION OF THE PRIOR ART

A number of patents which describe various kinds of portable or temporary structures for stages of other modular buildings, and the like, are known to the inventor herein. They included the following:

French Patent 802,239 issued Jun. 6, 1936 teaches a portable shelter or hangar that is intended for use to protect small airplanes. The portable hangar is provided in two parts, each of which comprises a plurality of wedged shape panels which are articulated and spread away from a centrally located mast.

Published British Patent Specification 1,367,064, published Sep. 18, 1974, relates to a collapsible garage which has a main frame covered with canvas, together with a plurality of arched members which are hinged to a pair of spaced apart base members. The arched members open much like a so-called Japanese fan.

Beckman U.S. Pat. No. 1,765,295, issued Jun. 17, 1930, relates to a tractor boom crane which can be mounted on a tractor such as a farm tractor, and opened out so as to be used otherwise as a hoist by being supported at its outer end.

A portable garage is taught in Stout U.S. Pat. No. 2,155,876, issued Apr. 25, 1939. Its principal feature is to provide a foldout shelter at each side of a towable building.

Another mobile building structure is taught in Sickel U.S. Pat. No. 2,755,517, issued Jul. 24, 1956. The purpose here is to provide such as an exhibition or sales structure that may be carried from time to time at exhibitions, conferences, auxiliary hospitals, and the like. The structure, once built, surrounds a centre post, and thus has limited free span.

A portable stage which may be carried to the site where it is to be used for an outdoor performance or the like, by being towed on a trailer is taught in Analetto U.S. Pat. No. 4,026,076, issued May 31, 1977. The stage is towed into place by being placed length wise of the trailer, and is then erected by first turning a turntable and then maneuvering a plurality of joists into place, after which a floor is constructed across the joists.

Gibbs U.S. Pat. No. 4,045,926, issued Sep. 6, 1977, teaches a roof structure for modular buildings which, again, may towed lengthwise on a trailer and then constructed into place by being put over a pair of spaced supports.

Another portable stage is taught in Hanley U.S. Pat. No. 4,232,488, issued Nov. 11, 1980. Once again, an articulated stage is towed into placed and then opened by being folded out from a central supporting structure.

Another structure having a supported floor which is transportable on the road but which is convertible for use as a stage or tribune is taught in Jonckheere U.S. Pat. No. 4,976,485, issued Dec. 11, 1990. This structure, as many others which relate to portable stages and the like, does not provide any shelter, but merely provides a surface on which a performance or other ceremony or activity can occur after the portable stage has been erected.

Yet another portable performance platform is taught in Boers U.S. Pat. No. 5,152,109, issued Oct. 6, 1992. Once again, an articulated upper surface is provided; and in this case also a lower surface, so that the stage or performance platform is sheltered.

Another mobile erectable stage and sound shell is taught in Uhl U.S. Pat. No. 5,327,698, issued Jul. 12, 1994. This patent again teaches a stage which can be towed on a trailer from one location to another, and is provided with a boom assembly to erect the stage by raising at least one sidewall panel and the interconnected roof panel. Nonetheless, the structure is a stage having specific structure which contains reversible acoustic panels, whereby stage performers can elect to use microphones, or not.

A transportable foldable building, and a method for erecting the same, is taught in Smith U.S. Pat. No. 5,461,832, issued Oct. 31, 1995. Here, a platform is supported in vertically spaced relation above a towable foundation, and then first and second outer roof sections are pivotally attached. Assembly of the foldable building is time consuming and expensive.

Murphy U.S. Pat. No. 5,960,593, issued Oct. 5, 1999, teaches a collapsible building which, again, may be towed into place. Here, however, a plurality of ground engaging support legs are put into place, and then a collapsible floor which has a number of hinged panels that collapse onto a chassis, followed by placement of a folding roof.

Loomans U.S. Pat. No. 6,082,059, issued Jul. 4, 2000, teaches a concrete construction system which uses articulated forms. A structure which is towable into place is not, per se, revealed in this patent.

Contrary to the above, the present inventor has quite unexpectedly discovered that an erectable structure can be provided, which is based on, and folded or articulated away from, a towable boom. The boom forms an integral part of the structure at one side thereof; and when the portable enclosure is erected a free span interior for the structure is provided into which construction equipment and the like may be placed for repair and maintenance work, or construction materials may be placed for storage, and so on.

SUMMARY OF THE INVENTION

To that end, therefore, the present invention provides a portable enclosure for temporary shelter purposes as a storage building or workshop at remote construction sites. The portable enclosure comprises a towable boom and a plurality of articulable frames mounted thereon.

The towable boom has coupling means at a first end for coupling to a towing tractor, and it has wheels at a remote second end so that the towable boom may be towed over roads and worksite terrain to the construction site at which it will be placed.

The plurality of articulable frames each comprises at least a first frame member, a second frame member, a third frame member, and a fourth frame member.

There is also a plurality of fluid operated extendable cylinders mounted on each articulable frame.

A first cylinder is mounted between the boom and the first frame member of each articulable frame, so as to adjust the angular disposition of the first frame member with respect to the boom.

A second cylinder is mounted between the second and third frame members of each articulable frame so as to adjust the angular disposition thereof with respect to each other.

Each of the first cylinders operates to move its respective first frame member, from a first, tilted position with respect to the boom, to a second, substantially vertical orientation.

Each of the second cylinders operates to move its respective second and third frame members from a first position whereat an acute angle is formed between the second and third frame members, to a second position whereat the angle formed between the second and third frame members is greater than the first position angle.

Each of the fourth frame members of each articulated frame is articulated to its respective third frame member so as to depend in a downwardly direction from the end thereof which is remote from its connection to the respective second frame member. Thus, the fourth frame member will assume a substantially vertical orientation when the second and third frame members have assumed their respective second positions.

Accordingly, each of the respective first and fourth frame members of each frame is articulable to a substantially vertical orientation, and they are thus capable of being horizontally distanced one from the other so as to constitute a storage or workshop space therebetween.

Typically, a web-like fabric material is spread between adjacent frame members and is secured thereto. Thus, rigid panels are not employed to enclose the interior volume of the portable enclosure.

The frame member of each frame may be extensible, and if so there is a third cylinder which is mounted thereon so as to cause an extending action of that fourth frame member.

Also, a wheel may be mounted at the bottom of each fourth frame member. Thus, the horizontal spacing between the respective first and fourth frame members of each frame may be adjusted while maintaining a substantially vertical orientation of the first and fourth frame members. That adjustment, as will be understood hereafter, is of the fourth frame member toward or away from the first frame member, which it will be recalled is mounted to the boom.

The towable boom may, itself, be extensible. If so, it has at least first and second boom portions. The wheels are mounted at the remote end of the second boom portion, and at least one articulable frame member may be mounted on each of the first and second boom portions.

Typically, each of the first, second, and third frame members of each respective articulable frame is extensible. Thus, its length may be extended from a first, closed position, to a second, extended position. Accordingly, the width and height measurements of an enclosure when the first and fourth frame members have assumed their vertical orientations, may be adjusted.

Moreover, in such circumstances, each of the first, second, and third frame members comprises first and second frame member portions, and each includes a respective, internally mounted, fluid operated extendable cylinder. Thus, the respective first and second frame member portions of each frame member may be extended one from the other.

Typically, each of the fluid operated extendable cylinders is hydraulic, but other fluid operated extendable cylinders such as compressed air or pneumatic cylinders, air over oil, and so on, may be employed.

A fourth cylinder may be mounted between the third and fourth frame members so as to adjust the angular disposition thereof, with respect to each other.

Otherwise, the fourth frame member of each articulable frame may be freely articulated to its respective third frame member.

Each wheel may be articulated to its respective fourth frame member so as to be swung vertically away from the bottom of the respective fourth frame member when the fourth frame member is in its first position.

Typically, the angle between the second and third frame members of each of the articulable frames, when in their respective second positions, is greater than 90°.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

Figure 1:
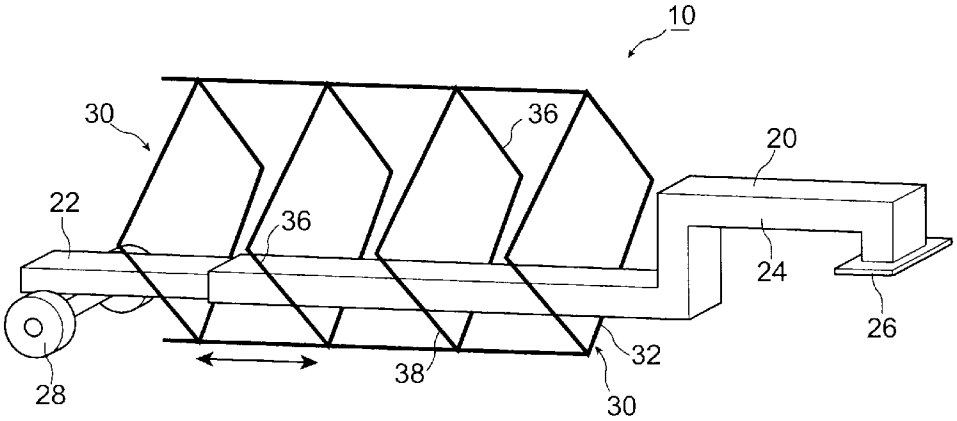
FIG. 1 is a schematic drawing showing the principal features of the present invention, when the portable enclosure is in its towing configuration.
Figure 2:
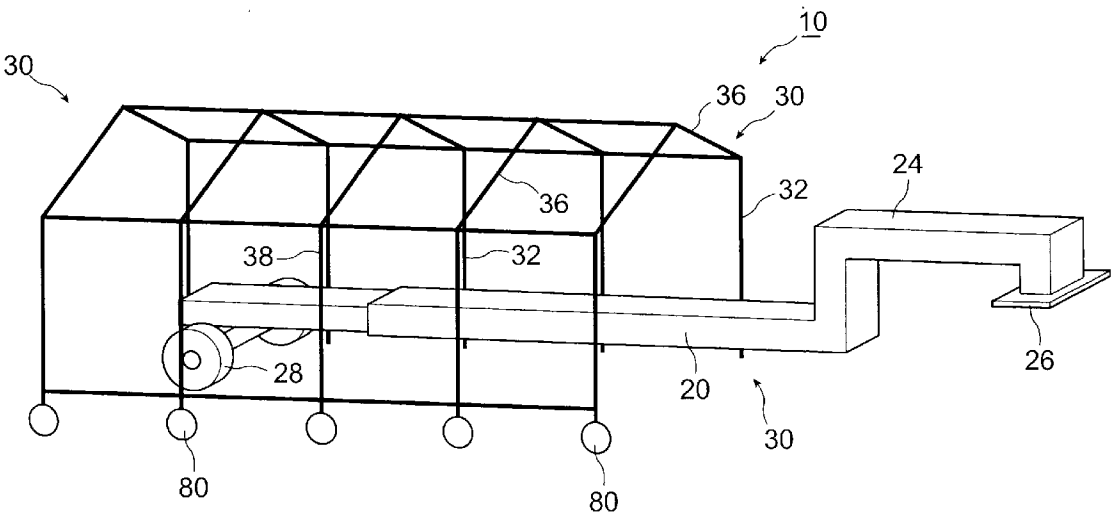
FIG. 2 is a view similar to FIG. 1, showing the portable enclosure in its erected configuration.

Several of the principal functions of portable enclosures in keeping with the present invention, and their characteristics, are described first in association with FIGS. 1 and 2.

A portable enclosure is illustrated at 10, at least so far as the fundamental components thereof are schematically shown.

A towable boom is shown at 20, 22 in FIG. 1, and at 20 in FIG. 2. As suggested in FIG. 1, the towable boom may be extendable, and comprises two portions one of which slides into the other—in this case, the second portion 22 slides into the first portion 20, in FIG. 1. In any event the towable boom 20 may have a yolk 24 and a fifth wheel connector 26 at its first end—the right end as seen in FIGS. 1 and 2—by which the boom 20 may be connected to a towing tractor. That tractor may be such as a 10-wheel truck tractor (not shown) of the sort commonly found on roads for towing trailers, flatbeds, floats, and the like. The towing tractor might also be a tracked vehicle, depending on the terrain over which the boom and the associated portable enclosure structure 10 are to be towed.

At the remote end of the boom 20, a wheel set 28 is shown, by which the boom 20 and the associated portable enclosure structure 10 may be towed over roads and work-site terrain.

A principal feature of the portable enclosure structure 10 is that it comprises a plurality of articulable frames 30, which are mounted on the boom 20, or 20,22, as described hereafter. Each of the articulable frames 30 comprises four distinctive frame members, designated as the first frame member 32, second frame member 34, third frame member 36, and fourth frame member 38.

As will be seen hereafter, each of the frame members 32, 34, 36, and 38 may, themselves, comprise first and second portions so as to be extensible. Those features are described in association with FIGS. 3 and 4, hereafter.

It is important for an understanding of the present invention to understand that the framework of the portable enclosure 10 is actually the articulable frames 30, mounted on the boom 20 (or boom 20,22). While the length of the members 32, 34, 36, and 38 may change from the configuration of FIG. 1 to the configuration of FIG. 2, as discussed hereafter, the fact remains that it is those frames 30 which will define the enclosure when it is in its erected configuration.

Briefly, without elaboration for now, each first frame member 32 moves from a tilted position as it is shown in FIG. 1 to a substantially vertical orientation as it is shown in FIG. 2. Each of the second and third frame members 34, 36 move from a first position indicated in FIGS. 1 and 3, where an acute angle is formed between them, to a second position indicated in FIGS. 2 and 4 where the angle between the second and third frame members 34, 36 is much greater than before—usually an obtuse angle greater than 90°—such that the second and third frame members 34, 36 effectively form the roof rafters of an enclosure in its open, erected configuration as shown in FIGS. 2 and 4.

Figure 4:
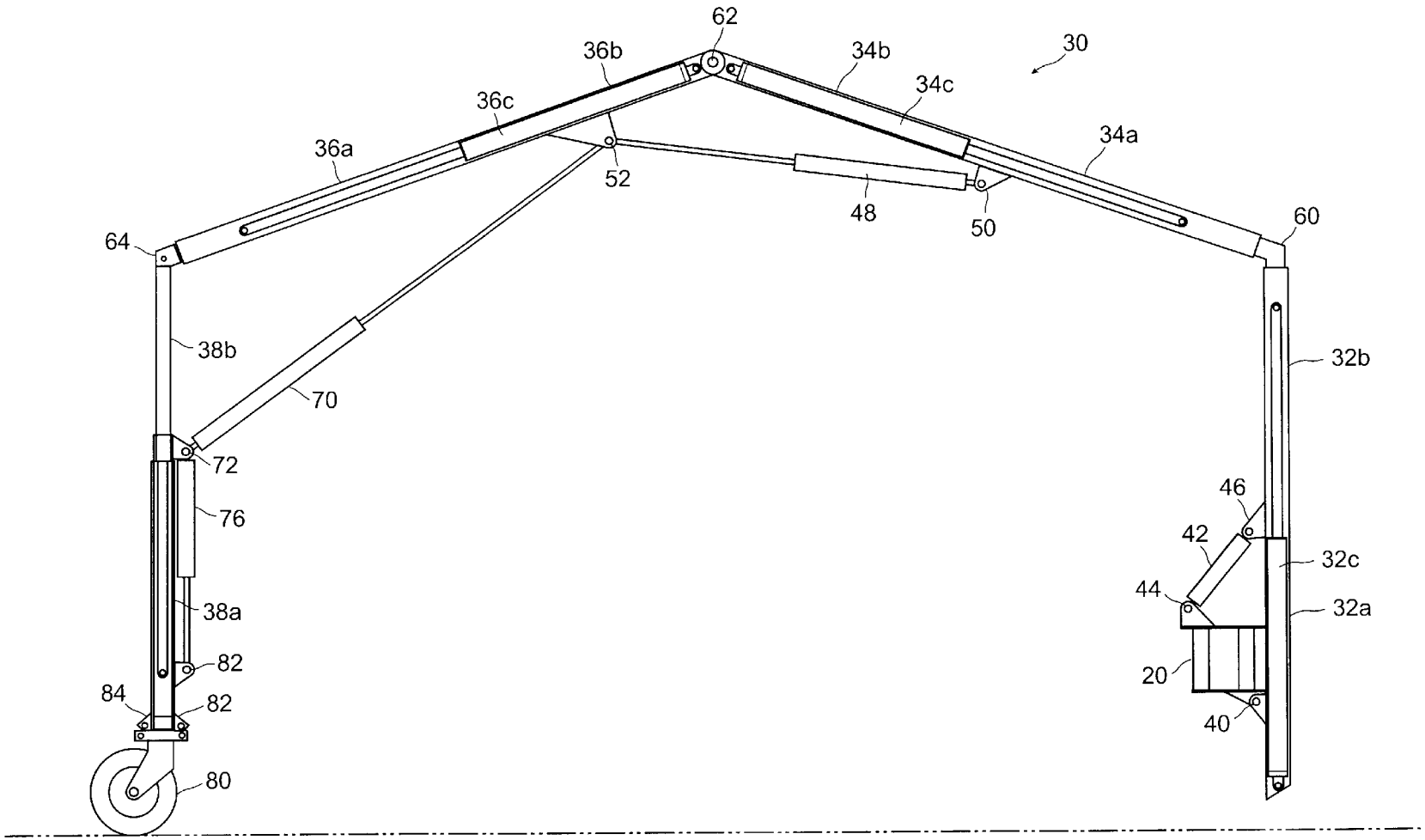
FIG. 4 is a view of the same frame, when in its erected configuration.

The fourth frame member 38 of each frame assumes a vertical orientation as shown in FIGS. 2 and 4, but it is now spaced away from the boom 20—to the left of the boom when viewed from its first end, as can be seen in any of the Figures of drawings.

It will be understood from a brief inspection of FIGS. 2 and 4 that considerable free span across the width of the erected enclosure is available from the inside side of the boom 20 to the inside sides of the fourth frame members 38.

Indeed, typically the inside dimensions of an enclosure 10, once erected, may be in the range of 6 to 12 meters wide and from 6 to 20 meters long.

Figure 3:
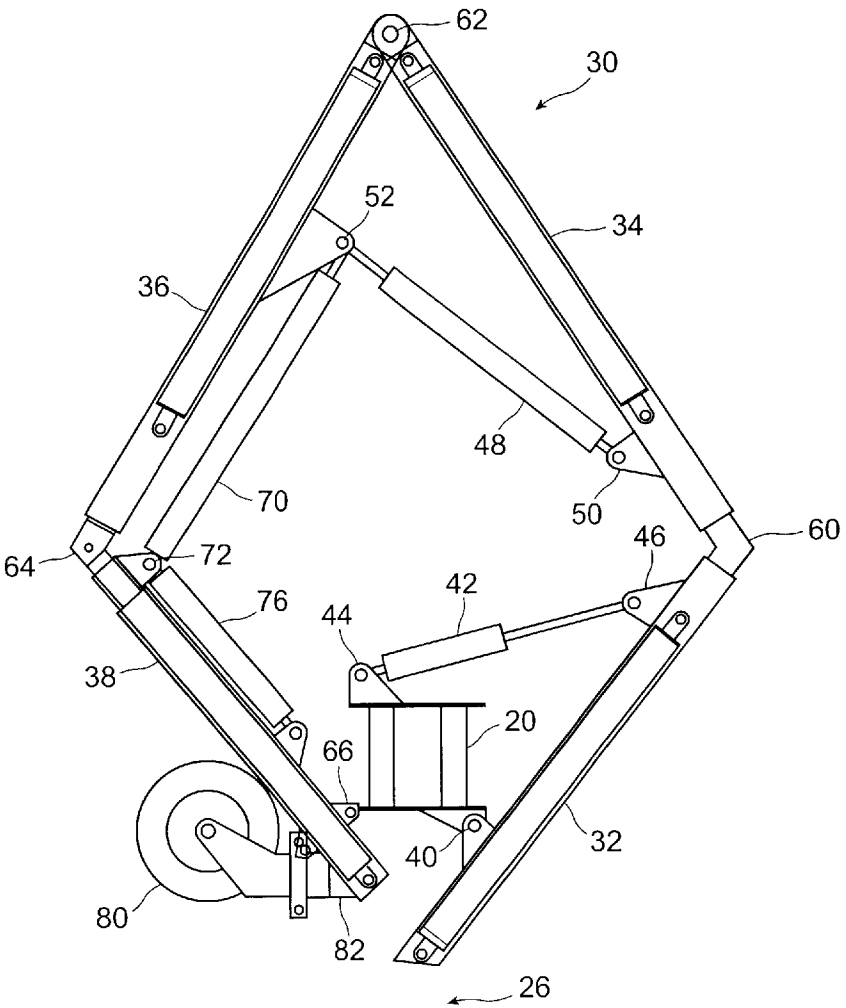
FIG. 3 is a view of a single articulable frame, in keeping with the present invention, when in its towing configuration.

The articulation of the portable enclosure from a closed configuration to an open configuration, as suggested in FIGS. 3 and 4, is now described.

First, it will be understood that each of the first frame members 32 is hinged to the boom 20, at 40. A first cylinder 42 is mounted to the boom 20 and the first frame member 32, at 44 and 46; and it will be clearly understood that operation of the first cylinder 42 will adjust the angular disposition of the first frame member 32 from its tilted position as shown in FIG. 3 to a substantially vertical orientation as shown in FIG. 4.

It will also be understood that the cylinder 42 is a fluid operated cylinder, typically hydraulic, but it may be pneumatic or air over oil, for example.

A second cylinder 48 is mounted to the second and third frame members 34, and 36, at 50 and 52, respectively.

Once again, it will be appreciated that operation of the cylinder 48 will open the second and third frame members 34 and 36 with respect to each other, by spreading them apart so as to assume a second, erected position as shown in FIG. 4.

Of course, it is understood that the second frame member 34 is articulated to the first frame member 32, as at 60; the second and third frame members 34, 36 are articulated one to the other at 62; and the third and fourth frame members 36, 38 are articulated one to the other at 64.

The articulation of the fourth frame member 38 to the third frame member 36 may be free, in that as the fourth frame member 38 is released from a locking position 66, where it is secured to the boom 20, and as the articulation of the frame 30 begins whereby the second and third frame members 34 and 36 are spread apart after or during the time when the first frame member 32 is being raised to its vertical orientation, the fourth frame member 38 may fall freely to assume a substantially vertical orientation.

Alternatively, a third cylinder 70 may be mounted to the third and fourth frame members 36 and 38 at 52 and 72, respectively, whereby the adjustment of the fourth frame member 38 to its substantially vertical orientation, as seen in FIG. 4, may be effected by operation of the cylinder 70.

Although the above discussion describes an embodiment of a portable enclosure in which articulation of the first frame member 32 to the second frame member 34 is free, as at 60, and articulation of the second frame member 36 to the fourth frame member 38 is free, as at 64, it is not necessary the case. The relationship between the first frame member 32 to the second frame member 34, as at 60, and the relationship of the third frame member 36 to the fourth frame member 38, as at 64, may be fixed. In the latter case, third cylinder 70 is not required.

It has been noted that each of the first to fourth frame members 32, 34, 36, and 38, may be extensible, whereby each comprises first and second portions 32*a*, 32*b* for the first frame member 32, and so on as seen in FIG. 4. In order for that extensibility to occur, interior cylinders 32*c*, 34*c*, and 36*c*, respectively may be mounted within the respective frame members.

On the other hand, the fourth frame member 38 may also be extensible, but that extensibility is governed by operation of a cylinder 76, mounted to the first and second portions 38*a*, 38*b* at 78 and 72, respectively.

Another reason for the extensibility of the fourth frame member 38*a*, 38*b* is that a wheel 80 may typically be mounted at the bottom end of the fourth frame member 38, and when its length is collapsed to that shown in FIG. 3, a cam 84 functions to swing the wheel vertically upwardly about articulation point 82, so as to move the wheel out of the way. It will be understood particularly from FIG. 3 that such configuration permits the towability of the portable enclosure structure 10 with sufficient ground clearance as shown at 86.

Thus, it will be clearly understood that articulation of each articulable frame 30 from the configurations shown in FIGS. 1 and 3 to those shown in FIGS. 2 and 4 are such whereby a storage or workshop space is effected between the first and fourth frame members 32, 38 and below the second and third frame members 34, 36.

It will also be understood that by the articulation and extensibility of the various frame members which comprise each articulable frame, and when necessary by extending the boom, the legal limits of height, width, and length, for a towed vehicle which travels over public roads, may be adhered to.

Typically, the width of the closed configuration of the articulable frames 30, as seen in FIG. 3, may be in the range of 2.5 to 2.8 meters. Likewise, the maximum height above the road may be in the range of 3.3 to 3.8 meters.

On the other hand, when the enclosure assumes its erected configuration as shown in FIGS. 2 and 4, as noted above the dimensions of the enclosure may be such as to accommodate even very large earth moving and construction equipment, and the like.

It will be evident that a web-like fabric material may be spread between the frame members 30, either after the structure is erected as shown in FIGS. 2 and 4, or it may be secured at least to the second and third frame members 34 and 36 and then may be tied to the first and fourth frame members 32 and 38. Likewise, end flaps or webs can be secured at both ends of the erected structure, so as to protect whatever is within the enclosure from the elements, and so as to permit the interior of the enclosure to be heated.

Furthermore, the fabric material may be secured to the articulable frames 30 in such a manner that the opening and closing operations of the fabric material over the frames 30 are controlled electronically.

It will also be evident that adjustment of the width and height of the erected enclosure may be made by appropriately adjusting any of the cylinders 48, 70, 76, and 32*c*, 34*c*, 36*c*, and 76. It will also be understood that the presence of the wheels 80 permits such adjustment, particularly in a sideways direction; and that each of the individual frames 30 is individually adjustable.

The necessary hydraulic and/or pneumatic circuits to control and permit adjustment of any of the cylinders is outside the scope of the present invention, and in any event will be well known and understood to those skilled in the art.

Specific details of the structures in keeping with the present invention will be also evident to those skilled in the art. Typically, the frame members and the boom are all constructed of steel, for purposes of ruggedness and longevity, but other suitable materials may be employed if necessary.

However, it will be understood that the weight of a portable enclosure structure 10, in keeping with this invention, is not excessive since the principal weight in many prior art shed structures—the steel panels which form the walls and roof of the structure—are not present and may, instead be replaced by a light weight web-like fabric such as plasticized tarpaulins and the like.

There has been described a portable enclosure for temporary shelter purposes, other embodiments of which, and variations of the construction and operation of which, may be made without departing from the spirit and scope of the appended claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., thus, a term substantially vertical is intended to convey the meaning of verticality or of being upright with respect to the horizontal, without necessarily defining an orientation which is specifically perpendicular with respect to the horizontal.

What is claimed is:

1. A portable enclosure for temporary shelter purposes as a storage building or workshop at remote construction sites, comprising:

a towable boom having coupling means at a first end for coupling to a towing tractor, and having wheels at a remote second end so that said towable boom maybe towed over roads and worksite terrain;

a plurality of articulable frames, each comprising at least a first frame member, a second frame member, a third frame member, and a fourth frame member; and a plurality of fluid operated extendible cylinders mounted on each articulable frame;

wherein a first cylinder is mounted between said boom and said first frame member of each articulable frame so as to adjust the angular disposition of said first frame member with respect to said boom;

wherein a second cylinder is mounted between said second and third frame members of each articulable frame so as to adjust the angular disposition thereof with respect to each other;

wherein each said first cylinder operates to move its respective first frame member from a first, tilted position with respect to said boom, to a second, substantially vertical orientation;

wherein each said second cylinder operates to move its respective second and third frame members from a first position whereat an acute angle is formed between said second and third frame members to a second position whereat the angle formed between said second and third frame members is greater than said first position angle; and wherein each said fourth frame member is articulated to its respective third frame member so as to depend in a downwardly direction from the end thereof remote from its connection to the respective second frame member, whereby said fourth frame member will assume a substantially vertical orientation when said second and third frame members have assumed their respective second positions;

whereby each of said respective first and fourth frame members of each frame is articulable to a substantially vertical orientation, and so as to be horizontally distanced one from the other, and so as to constitute a storage or workshop space therebetween.

2. The portable enclosure of claim 1, wherein a web-like fabric material is spread between adjacent frame members and is secured thereto.

3. The portable enclosure of claim 1, where each said fourth frame member is extensible, and has a third cylinder mounted thereon so as to cause an extending action thereof.

4. The portable enclosure of claim 3, wherein a wheel is mounted at the bottom of each fourth frame member, whereby the horizontal spacing between each respective first and fourth frame members of each frame may be adjusted while maintaining a substantially vertical orientation of said first and fourth frame members.

5. The portable enclosure of claim 1, wherein said towable boom is extensible and comprisies first and second boom portions, wherein said wheels are mounted at the remote end of said second boom portion, and wherein at least one frame member is mounted on each of said first and second boom portions.

6. The portable enclosure of claim 3, wherein each of said first, second, and third frame members of each respective frame is extensible, whereby the length of each may be extended from a first, closed position to a second, extended position, and whereby the width and height measurements of an enclosure when said first and fourth frame members have assumed their respective vertical orientations, may be adjusted.

7. The portable enclosure of claim 6, wherein each of said first, second, and third frame members comprises first and second frame member portions, and includes a respective, internally mounted, fluid operated extendible cylinder, whereby the respective first and second frame member portions may be extended one from the other.

8. The portable enclosure of claim 1, wherein said fluid operated extendible cylinders are hydraulic.

9. The portable enclosure of claim 3, wherein a fourth cylinder is mounted between said third and fourth frame members so as to adjust the angular disposition thereof with respect to each other.

10. The portable enclosure of claim 1, wherein said fourth frame member of each frame is fully articulated to its respective third frame member.

11. The portable enclosure of claim 4, wherein each wheel is articulated to said respective fourth frame member so as to be swung vertically away from the bottom of the respective fourth frame member when said fourth frame member is in its first position.

12. The portable enclosure of claim 1, wherein the angle between said second and third frame members of each articulable frame, when in their respective second positions, is greater than 90°.

* * * * *